US005803522A

United States Patent [19]

Lisbon

[11] Patent Number: 5,803,522

[45] Date of Patent: Sep. 8, 1998

[54] RECYCLABLE BAG-HANDLE GRIP

[76] Inventor: Alfred F. Lisbon, 1645 S. Shenandoah St., Los Angeles, Calif. 90035

[21] Appl. No.: 934,186

[22] Filed: Sep. 19, 1997

[51] Int. Cl.[6] ..... A45F 5/10; B65D 33/06

[52] U.S. Cl. ..... 294/171; 294/149

[58] Field of Search ..... 294/137, 138, 294/141–143, 149, 152, 153, 156, 158, 165, 166, 170, 171; 16/114 RB, 116 R; 74/551.9, 558; 190/116; 229/87.01, 93, 117.19, 117.23–117.25; 383/6, 13, 25, 26; D9/434, 455

[56] References Cited

U.S. PATENT DOCUMENTS

| | | | |
|---|---|---|---|
| 736,632 | 8/1903 | Priddat | 294/171 |
| 2,215,116 | 9/1940 | Crary | 294/171 |
| 4,796,940 | 1/1989 | Rimland | 294/171 |
| 5,005,891 | 4/1991 | Lunsford | 294/171 |
| 5,658,029 | 8/1997 | Franko | 294/171 |

*Primary Examiner*—Johnny D. Cherry
*Attorney, Agent, or Firm*—A. M. Fernandez

[57] ABSTRACT

A disposable bag-handle grip is die cut from a pliable sheet of recyclable cardboard with two tab cuts along lines parallel to one end of the sheet and two arcuate cuts near the other end of the sheet to receive the tabs after the sheet has been inserted through openings cut in bags to serve as handles and folded along scored lines to place the one end over the other in position for the tabs to be pushed through the arcuate cuts. The tabs may have an optional cut at an acute angle that will catch on the arcuate cut to lock the tabs in place.

5 Claims, 2 Drawing Sheets

RECYCLABLE BAG-HANDLE GRIP

FIELD OF THE INVENTION

The invention relates to a recyclable bag-handle grip that may be inexpensively die cut from sheets of cardboard with locking tabs so that when bent around the handles of one or more bags, the grip locks around the bag handles.

BACKGROUND OF THE INVENTION

The need for a disposable bag handle grip has long been recognized in order to facilitate carrying one or more heavily loaded bags, particularly the plastic grocery bags that have openings cut out on the sides near the top for handles. One would expect that, but for the cost, the grocer would make a suitable bag-handle grip available to every customer passing through a checkout stand. Consequently, an object of the invention is to provide an inexpensive disposable bag-handle grip that is made of recyclable material, that also has some benefit for the grocer or other merchant making it available, besides low cost and pleasing customers.

As evidence of this need for a bag-handle grip, see U.S. Pat. No. 5,005,891 which discloses such a grip 10 comprising a substantially rectangular sheet 22 of low density polyethylene having a two-dimensional mushroom shaped locking tab 28 at one end and a locking slot 32 at the other end which has a first orifice 34 of sufficiently wide dimension to allow the head 30 of the mushroom shaped tab 28 to pass through and another narrower orifice 36 connected to the first orifice 34 by a passage 38 to allow the stem 44 of the mushroom shaped tab 28 to pass into the orifice 36. The abutment 46 of the mushroom head 30 will then automatically lock the grip 10 in its cylindrical shape once the person applying the bag-handle grip releases the force bending the sheet 22 into that cylindrical shape.

The problem with this bag-handle grip is first to assure that the mushroom shaped tab enters the first orifice 34 and then passes into the second orifice 36 before releasing the bending force. Next the problem is assuring that upon reapplying a gripping force (which surely occurs upon grasping the bag-handle grip 10 to carry the bag or bags) the stem 44 of the mushroom head 30 does not pass back into the first orifice 34, because that would allow the head 30 to slide out upon once again releasing the bag-handle grip 10, such as upon placing the bag or bags on the ground while unlocking the door of an automobile or home.

If the bag-handle grip 10 should spring open in that fashion, the bag or bags would splay open and apart, thus spreading groceries on the ground. The term "spring" is here used judiciously because the bag-handle grip 10 is made of "semirigid flexible material" (identified as "low density polyethylene," a thermosetting plastic that exhibits resistance to creep and both high impact and tensile strength) and depends upon this "spring" action, i.e., this tendency for the plastic to resume its flat shape in order for the mushroom stem 44 to pass from orifice 32 to orifice 36 in order to lock the grip in the cylindrical shape. See the paragraph in column 3, line 45, to column 4, line 4, wherein the locking and deliberate unlocking procedure is described.

To appreciate the inadvertent unlocking just described above, consider FIG. 1 which shows a user's hand grasping the bag-handle grip 10 with the thumb over the slotted end 26 of the sheet 22. The thumb will hold the end 26 so that it will not spring outwardly and thus may prevent inadvertently unlocking the grip 10 upon releasing the grasp since the stem 44 could easily slide back into the slot 36 as the grasp is released. Then consider that if the thumb is not over the slotted end 26 when the bag-handle grip is grasped, that end of the sheet 22 would spring outwardly while the stem 44 of the tab would tend to pass through the narrow portion 38 to a position over the wide slot 34. The abutment 46 would then slip into the slot 34 upon releasing the grasp, and the mushroom head 28 would then be free to slide out completely free, thus releasing all of the bag handles.

STATEMENT OF THE INVENTION

The disposable bag-handle grip of the present invention comprises a rectangular pliable sheet of cardboard (a recyclable material) having at one end two linear cuts, one linear cut from each side of predetermined length parallel to that one end at a predetermined distance from that one end to form two locking tabs and having at the opposite end two arcuate cuts, one arcuate cut near each side, each arcuate cut facing the nearest side. The distance between the ends of each arcuate cut is substantially equal to the width of the locking tabs, so that when that one end with the locking tabs is passed through the bag handles and then bent around and over the opposite end of the pliable sheet, the tabs at the one end may be punched through the arcuate cuts at the other end which is then beneath the one end. The arcuate cuts are each set a distance from the sides of the sheet less than the predetermined length of the tabs so that the bag-handle grip will not fall open and release the bag handles without deliberately pulling the tabs out of the somewhat circular cuts. The cuts are preferably semicircular but are defined as being arcuate because they need not be of the precise semicircular shape. They may be of a shape that is half of an ellipse or a segment (less than half) of a circle, or any other arcuate shape.

In order to more securely lock the tabs in the arcuate cuts, an optional cut is made in each tab from the one end of the sheet with a dimension that is less than half the width of the tab in a direction toward the nearest side of the sheet at an acute angle of about 45° starting at a position a distance less than the distance of the end of an arcuate cut from the nearest side such that with the tab overlaying an optional cut the tab will catch on the edge of the arcuate cut once the tab is inserted, and it will not easily slide out.

The sheet of cardboard is scored at first and second predetermined places for causing a facilitated bending of the pliable sheet at a first predetermined place that will be under the bag handles and at a second predetermined place that will be over the bag handles, and at a distance from the one end which will assure that the one end with the tab will overlap the opposite end with the arcuate cuts in order for the tabs to be positioned over the arcuate cuts where they may be punched through the arcuate cuts.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
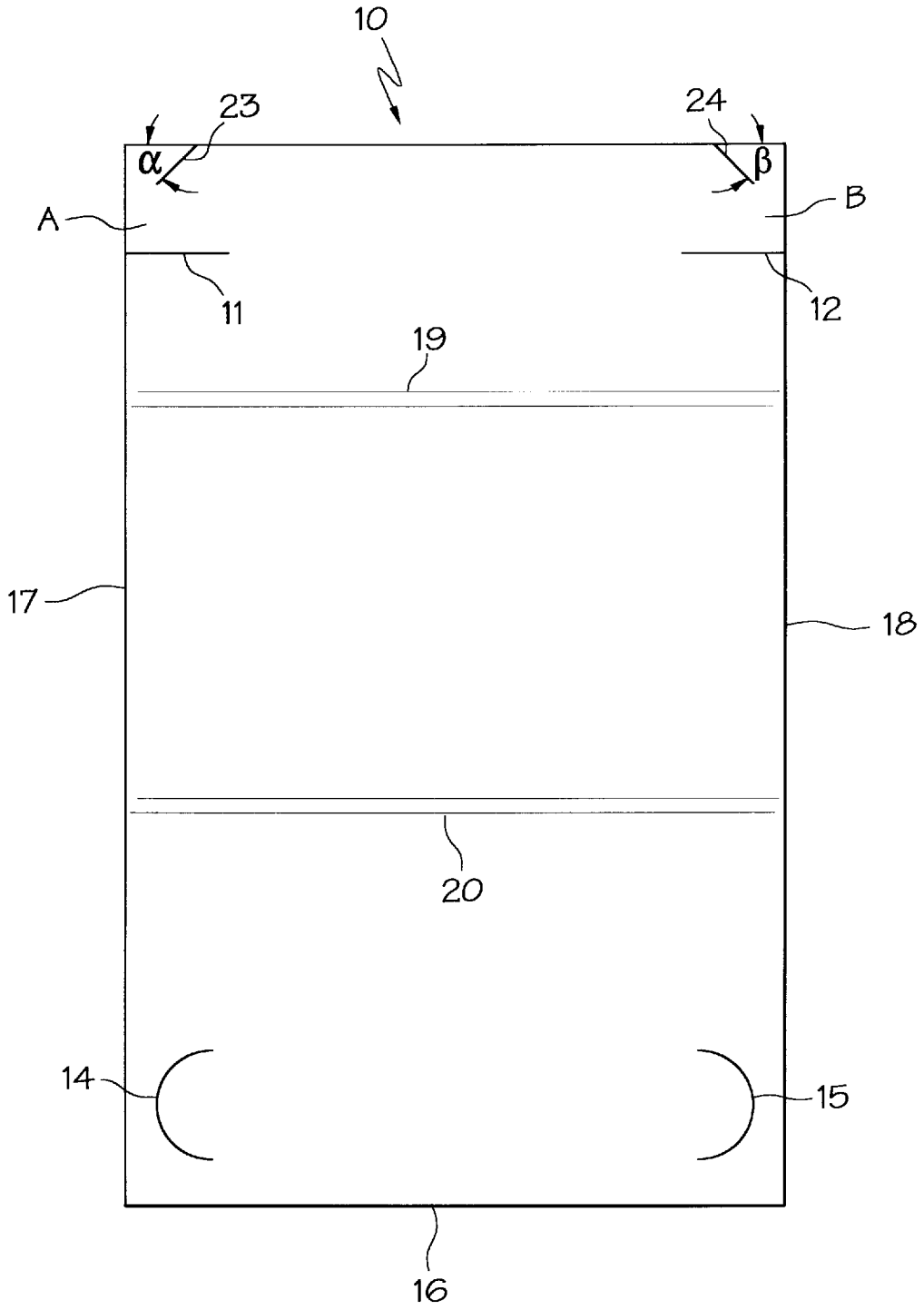
FIG. 1 is a plan view of a bag handle grip die cut in accordance with the present invention.

Referring to FIG. 1, a bag-handle grip 10 made in accordance with this invention is die cut in a rectangular shape from a flat sheet (in a range of about 9½ cm to 13 cm wide and 15½ to 21 cm long) made of pliable cardboard. At the same time, cuts 11 and 12 are made at one end 13 to form locking tabs A and B at a predetermined distance from the one end 13, and arcuate cuts 14 and 15 are made near the opposite end 16. These arcuate cuts are made close to and facing the nearest of the sides 17 and 18 of the grip 10, as shown.

The diameter of each of the arcuate cuts (14, 15) is selected to be substantially equal to the width of the locking tabs (A, B). That width is empirically determined to be sufficient, such as 2 cm, to prevent the tabs from easily bending outwardly in the plane of the pliable sheet of cardboard shown in FIG. 1 and possibly tearing off after the one end 13 is passed through the bag handles and bent around over the opposite end 16 to a position where the tabs A and B may be punched through the respective arcuate cuts 14 and 15 that are preferably semicircular.

The semicircular cuts 14 and 15 are each at a distance less than about 1 cm from the respective sides 17 and 18 which is significantly less than the predetermined length of the tabs which should be about twice the width of the tabs, namely about 4 cm.

Figure 2:
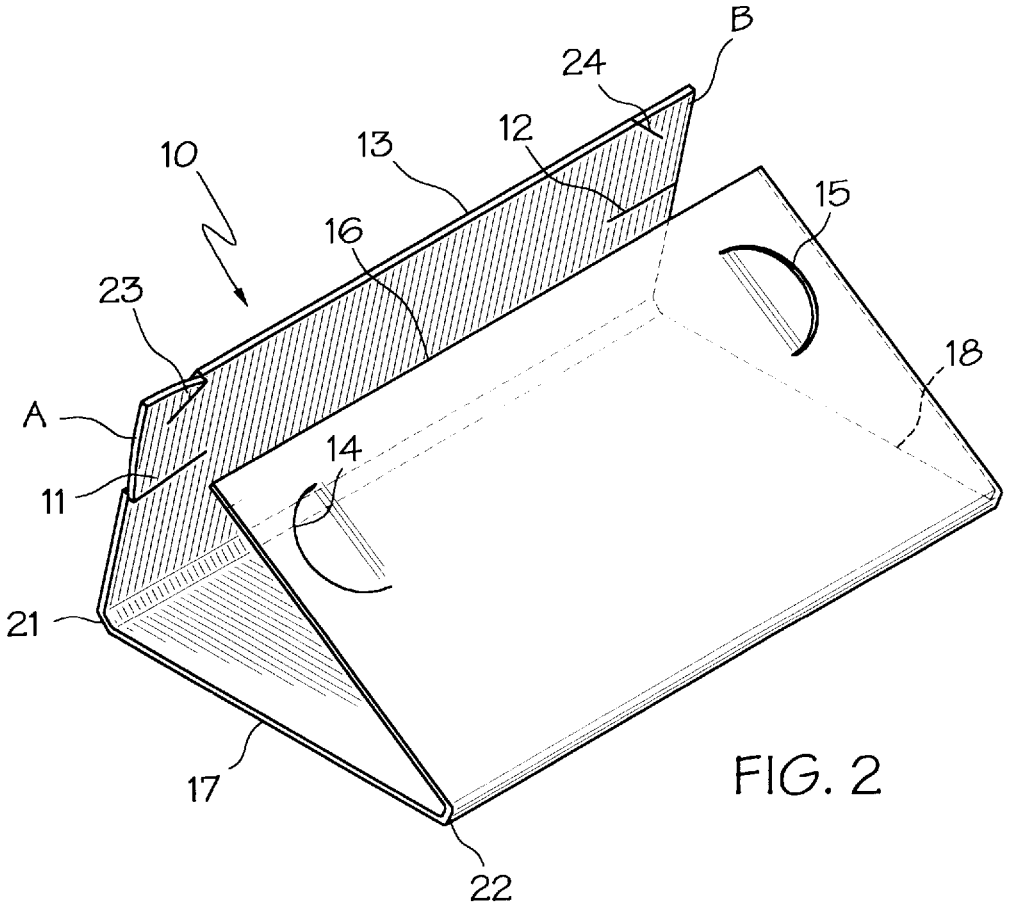
FIG. 2 illustrates the bag handle grip of FIG. 1 bent at first and second predetermined places so that one end having tab cuts will overlap an opposite end having semicircular cuts.
Figure 3:
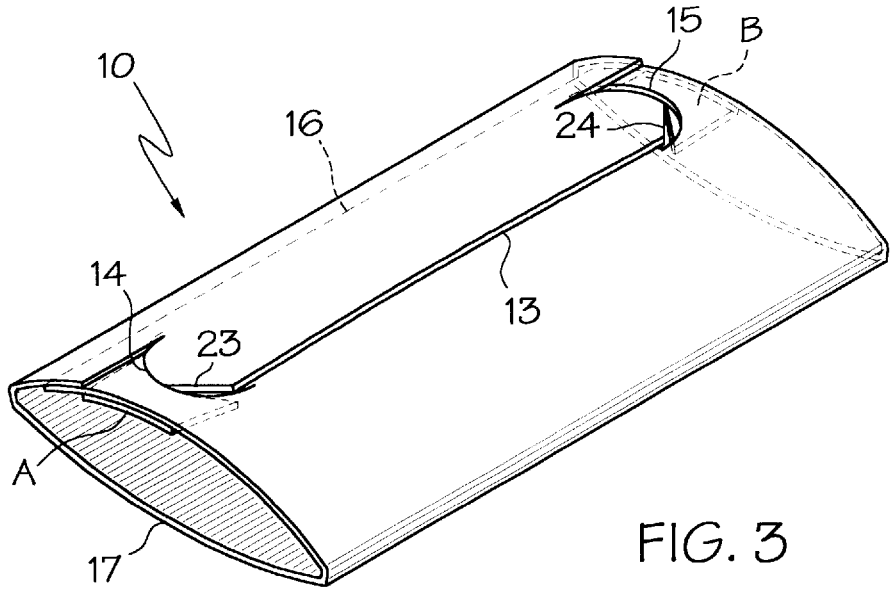
FIG. 3 illustrates the bag handle grip of FIG. 1 locked around plastic bag handles with the locking tabs locked in the semicircular cuts so that it will hold the handles of one or more bags together without a person's hand on the grip.

In order to facilitate folding the rectangular sheet of pliable cardboard shown in FIG. 1 through and around the bag handles so that the end 13 overlaps the end 16, the sheet is scored on one or two lines indicated by dashed lines 19 and 20 in FIG. 1 where the bends 21 and 22 shown in FIG. 2 should occur. Once the end 13 has overlapped the end 16 to place the tabs A and B in alignment with the respective semicircular cuts 14 and 15, the user simply punches the tabs through the respective semicircular cuts as shown in FIG. 3. The bag-handle grip 10 is then locked in place around the bag handles as shown.

In order to more securely lock the tabs A and B in the respective semicircular cuts, optional cuts 23 and 24 may be made in the tabs A and B as shown in FIG. 1. Each additional cut is made from the one end 13 of the sheet a length less than half the width of the tab (less than about 1 cm) at equal acute angles $\alpha$ and $\beta$ in a direction toward the nearest side of the sheet starting at a position a distance less than the distance of the end of a semicircular cut from the nearest side, such that with the tab overlaying a semicircular cut the additional cut is tangential to the semicircular cut. Each of the optional cuts 23 and 24 in the tabs A and B will thus catch the edge of the respective semicircular cuts 14 and 15 as shown in FIG. 3 for a positive lock of the tabs in the semicircular cuts. To unlock the tabs, it is then necessary to use positive force to extract the tabs from the semicircular cuts.

The advantage of this architecture of a bag-handle grip and the use of recyclable cardboard is not only a more secure locking of the tabs once the grip is put in place around the handles of bags, but also lower cost so that it may be readily discarded and recycled with other cardboard or paper after just one use. A further advantage is that it is also a potential benefit to the grocer or other business establishment dispensing the grip for customer's convenience with its logo and/or advertisements. Thus, it not only promotes good customer relations but also presents another medium through which goods or services may be advertised by printing the logo and/or advertisements on a sheet of cardboard before the grips are die cut.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. A disposable bag-handle grip comprising a rectangular pliable sheet of cardboard having at one end two linear cuts, one linear cut of predetermined length cut from each side of said sheet of pliable cardboard, said cuts being parallel to said one end at a predetermined distance from said one end to form two locking tabs of predetermined width, and having at an end opposite said one end two arcuate cuts for receiving said tabs, one arcuate cut for each tab near each side of said rectangular sheet of pliable cardboard, each arcuate cut having a distance between the ends thereof substantially equal to the predetermined width of said locking tabs.

2. A disposable bag-handle grip as defined in claim 1 wherein each tab is provided with a cut at an acute angle from said one end of said sheet of pliable cardboard toward the nearest side thereof starting at a point a distance from said nearest side equal to the distance of the end of said arcuate cut from said nearest side.

3. A disposable bag-handle grip as defined in claim 1 wherein said arcuate cuts for receiving said tabs are each semicircular.

4. A disposable bag-handle grip as defined in claim 1 wherein lines are scored at first and second places between said one end and said opposite end of said sheet of pliable cardboard for facilitating the bending at said first and second places.

5. A disposable bag-handle grip as defined in claim 4 wherein said first and second places of scored lines are selected so that said one end folds over said opposite end with said two tabs directly over said two arcuate cuts.

* * * * *